United States Patent [19]

Thomson

[11] Patent Number: 4,972,490

[45] Date of Patent: Nov. 20, 1990

[54] DISTANCE MEASUREMENT CONTROL OF A MULTIPLE DETECTOR SYSTEM

[75] Inventor: David L. Thomson, Warrenville, Ill.

[73] Assignee: AT&T Bell Laboratories, Murray Hill, N.J.

[21] Appl. No.: 410,039

[22] Filed: Sep. 20, 1989

Related U.S. Application Data

[63] Continuation of Ser. No. 34,297, Apr. 3, 1981, abandoned.

[51] Int. Cl.[5] ..... G10L 3/02

[52] U.S. Cl. ..... 381/49; 381/38

[58] Field of Search ..... 364/513.5; 381/36–40, 381/43, 45, 48–50

[56] References Cited

U.S. PATENT DOCUMENTS

| | | | |
|---|---|---|---|
| 3,947,638 | 3/1976 | Blankenship | 381/49 |
| 4,074,069 | 2/1978 | Tokura et al. | 381/38 |
| 4,360,708 | 11/1982 | Taguchi et al. | 381/36 |
| 4,393,272 | 7/1983 | Itakura et al. | 381/39 |
| 4,472,747 | 9/1984 | Schwartz | 360/32 |
| 4,559,602 | 12/1985 | Bates, Jr. | 364/487 |
| 4,592,085 | 5/1986 | Watari et al. | 381/43 |
| 4,879,748 | 11/1989 | Picone et al. | 381/49 |

FOREIGN PATENT DOCUMENTS 149705 12/1976 Japan .

OTHER PUBLICATIONS

"Optimization of Voiced/Unvoiced Decisions in Nonstationary Noise Environments", Hidefumi Kobatake, vol. No. 1, pp. 9–18, 1/87, IEEE.

"Fast and Accurate Pitch Detection Using Pattern Recognition and Adaptive Time-Domain Analysis", D. P. Prezas et al., CH2243, pp. 109–112, 4/86, AT&T.

"Voiced/Unvoiced Classification of Speech with Applications to the U.S. Government LPC-10E Algorithm", J. P. Campbell et al., pp. 473–476, DOD.

"Implementation of the Gold-Rabiner Pitch Detector in a Real Time Environment Using an Improved Voicing Detector", H. Hassanein et al., vol. No. 1, pp. 319–320, 2/85, IEEE.

"Long-Term Adaptiveness in a Real-Time LPC Vocoder", N. Dal Degan et al., vol. XII-No. 5, pp. 461–466, 10/84, CSELT Technical Reports.

"A Statistical Approach to the Design of an Adaptive Self-Normalizing Silence Detector", P. De Souza, vol. No. 3, pp. 678–684, 6/83, IEEE.

"A Procedure for Using Pattern Classification Techniques to Obtain a Voiced/Unvoiced Classifier", L. J. Siegel, vol. No. 1, pp. 83–89, 2/79, IEEE.

"A Pattern Recognition Approach to Voiced-Unvoiced-Silence Classification with Applications to Speech Recognition", B. S. Atal et al., vol. No. 3, pp. 201–212, 6/76, IEEE.

Gold and Rabiner, "Parallel Processing Techniques for Estimating Pitch Periods of Speech in the Time Domain", The Journal of the Acoustical Society of America, vol. 46, No. 2 (part 2), 1969, pp. 442–448.

*Primary Examiner*—Dale M. Shaw
*Assistant Examiner*—David D. Knepper
*Attorney, Agent, or Firm*—John C. Moran

[57] ABSTRACT

Apparatus for detecting a fundamental frequency in speech utilizing a plurality of voiced detectors and selecting one of those detectors to make the voicing decision utilizing distance measurement values with each value generated by one of the voiced detectors. The voiced detector selected is the one which generated the best distance measurement value. The distance measurement value may be the Mahalanobis distance value or Hotelling's two-sample $T^2$ statistic. Two types of voiced detectors are disclosed: statistical voiced detectors and discriminant voiced detectors. The disclosed statistical voiced detector adapts to changing speech environments by detecting changes in the voice environment in response to classifiers that define certain attributes of the speech.

23 Claims, 4 Drawing Sheets

DISTANCE MEASUREMENT CONTROL OF A MULTIPLE DETECTOR SYSTEM

This application is a continuation of application Ser. No. 07/034,297, filed on Apr. 3, 1987, now abandoned.

This invention relates to determining whether or not speech has a fundamental frequency present. This is also referred to as a voicing decision. More particularly, the invention is directed to selecting one of a plurality of voiced detectors which are concurrently processing speech samples for making the voicing decision with the selection being based on a distance measurement calculation.

BACKGROUND AND PROBLEM

In low bit rate voice coders, degradation of voice quality is often due to inaccurate voicing decisions. The difficulty in correctly making these voicing decisions lies in the fact that no single speech classifier can reliably distinguish voiced speech from unvoiced speech. The use of multiple voiced detectors and the selection of one of these detectors to make the determination of whether the speech is voiced or unvoiced is disclosed in the paper of J. P. Campbell, et al., "Voiced/Unvoiced Classification of Speech with Applications to the U.S. Government LPC-10E Algorithm", IEEE International Conference on Acoustics, Speech, and Signal Processing, 1986, Tokyo, Vol. 9.11.4, pp. 473–476. This paper discloses the utilization of multiple linear discriminant voiced detectors each utilizing different weights and threshold values to process the same speech classifiers for each frame of speech. The weights and thresholds for each detector are determined by utilizing training data. For each detector, a different level of white noise is added to the training data. During the processing of actual speech, the detector to be utilized to make the voicing decision is determined by examining the signal-to-noise ratio, SNR. The range of possible values that the SNR can have is subdivided into subranges with each subrange being assigned to one of the detectors. For each frame, the SNR is calculated, the subrange is determined, and the detector associated with this subrange is selected to make the voicing decision.

A problem with the prior art approach is that it does not perform well with respect to a speech environment in which characteristics of the speech itself have been altered. In addition, the method used by Campbell is only adapted to white noise and cannot adjust for colored noise. Therefore, there exists a need for a method of selecting between a plurality of voiced detectors that allows detection in a varying speech environment.

SOLUTION

The above described problem is solved and a technical advance is achieved by a voiced decision apparatus that selects between a plurality of voiced detectors by comparing separation or merit values generated by each of the voiced detectors. The separation values are also referred to as distance measurements.

Advantageously, the apparatus comprises different types of voiced detectors such as discriminant and statistical detectors each generating a separation value. A comparator within the apparatus selects the voiced detector to make the determination whether the speech is voiced or unvoiced that is generating the largest separation value. Advantageously, the separation value may be a statistical, generalized distance value.

All of the voiced detectors indicate whether a frame is voiced or unvoiced and each of the detectors first determines a discriminant variable for each one of the present and previous frames. After determining the variable, each of the detectors determines mean values for both voiced and unvoiced ones of the previous and present frames. Each detector determines variance values for voiced and unvoiced ones of the previous and present frames. After calculating the means and the variances, each detector determines the separation value from the mean and variance values for the voiced frames and the mean and variance values for the unvoiced frames.

Advantageously, the determination of the separation values is performed in each detector by combining variance values into a weighted sum. The mean value of each of the unvoiced frames is subtracted from the mean value of each of the voiced frames. This subtracted value is squared for each of the frames and the weighted sum of the variance values is divided into the resulting squared subtracted value. Advantageously, before forming the weighted sum, each detector multiplies the variance value for the voiced frames by the probability of a voiced frame occurring, and multiplies the variance value for the unvoiced frames by the probability of an unvoiced frame occurring. In addition, before dividing the squared subtracted value by weighted sum, the squared subtracted value is multiplied by the probabilities of a voiced frame occurring and unvoiced frame occurring.

The method comprises the steps of calculating a first merit value defining the separation between voiced and unvoiced frames by the discriminant detector, calculating a second merit value defining separation between voiced and unvoiced frames by said statistical voiced detector, and selecting the detector that calculated the best merit value to indicate whether a frame is voiced or unvoiced.

BRIEF DESCRIPTION OF THE DRAWING

The invention may be better understood from the following detailed description which when read with reference to the drawing in which.

DETAILED DESCRIPTION

Figure 1:
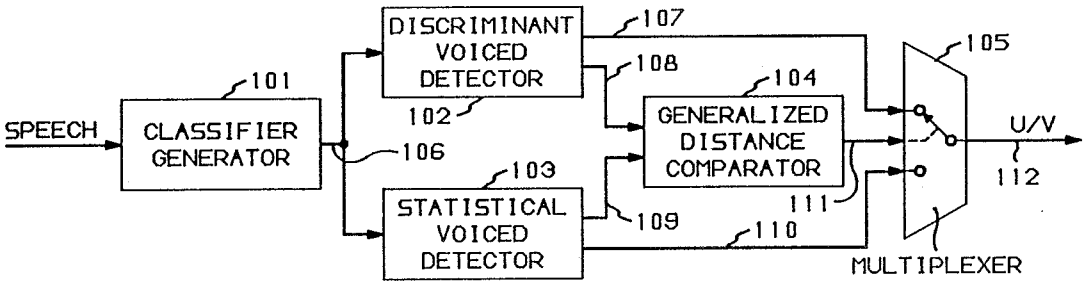
FIG. 1 is a block diagram illustrating the present invention.

FIG. 1 illustrates an apparatus for performing the unvoiced/voiced decision operation by selecting between one of two voiced detectors. It would obvious to one skilled in the art to use more than two voiced detectors in FIG. 1. The selection between detectors 102 and 103 is based on a distance measurement that is generated by each detector and transmitted to distance comparator 104. Each generated distance measurement represents a merit value indicating the correctness of the generating detector's voicing decision. Distance comparator 104 compares the two distance measurement values and controls a multiplexer 105 such that the detector generating the greatest distance measurement value is selected to make the unvoiced/voiced decision. However, for other types of measurements, the lowest merit value would indicate the detector making the most accurate voicing decision Advantageously, the distance measurement may be the Mahalanobis distance. Advantageously, detector 102 is a discriminant detector, and detector 103 is a statistical detector. However, it would be obvious to one skilled in the art that the detectors could all be of the same type and that there could be more than two detectors present in the system.

Consider now the overall operation of the apparatus illustrated in FIG. 1. Classifier generator 101 is responsive to each frame of speech to generate classifiers which advantageously may be the log of the speech energy, the log of the LPC gain, the log area ratio of the first reflection coefficient, and the squared correlation coefficient of two speech segments one frame long which are offset by one pitch period. The calculation of these classifiers involves digitally sampling analog speech, forming frames of the digital samples, and processing those frames and is well known in the art. In addition, Appendix A illustrates a program routine for calculating those classifiers. Generator 101 transmits the classifiers to detectors 102 and 103 via path 106.

Detectors 102 and 103 are responsive to the classifiers received via path 106 to make unvoiced/voiced decisions and transmit these decisions via paths 107 and 110, respectively, to multiplexer 105. In addition, the detectors determine a distance measure between voiced and unvoiced frames and transmit these distances via paths 108 and 109 to comparator 104. Advantageously, these distances may be Mahalanobis distances or other generalized distances. Comparator 104 is responsive to the distances received via paths 108 and 109 to control multiplexer 105 so that the latter multiplexer selects the output of the detector that is generating the largest distance.

Figure 2:
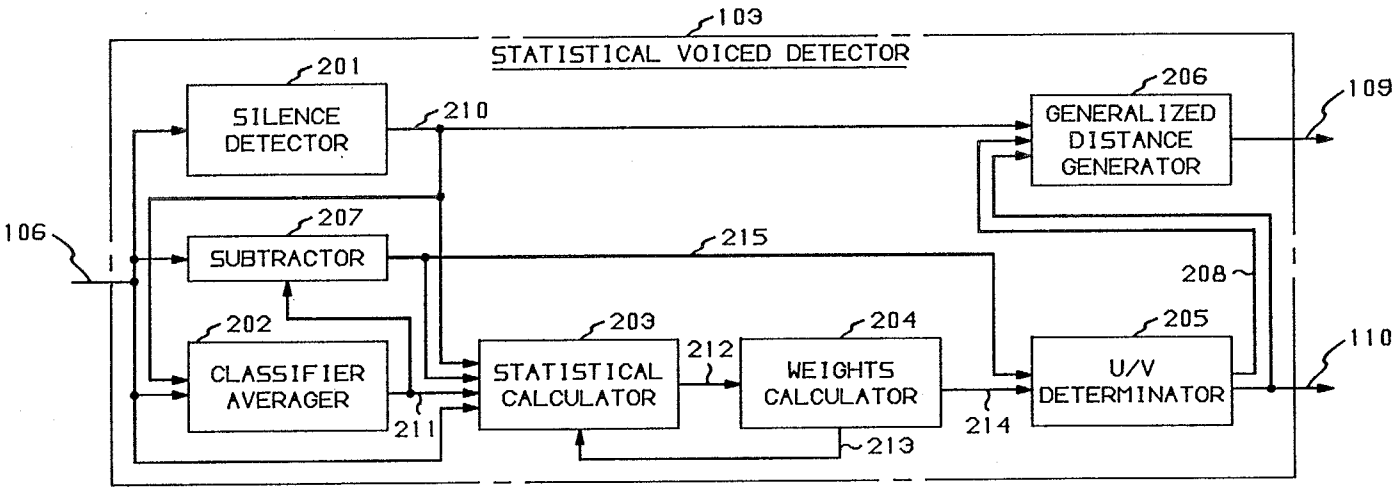
FIG. 2 illustrates, in block diagram form, statistical voice detector 103 of FIG. 1.

FIG. 2 illustrates, in greater detail, statistical voiced detector 103. For each frame of speech, a set of classifiers also referred to as a vector of classifiers is received via path 106 from classifier generator 101. Silence detector 201 is responsive to these classifiers to determine whether or not speech is present in the present frame. If speech is present, detector 201 transmits a signal via path 210. If no speech (silence) is present in the frame, then only subtractor 207 and U/V determinator 205 are operational for that particular frame. Whether speech is present or not, the unvoiced/voiced decision is made for every frame by determinator 205.

In response to the signal from detector 201, classifier averager 202 maintains an average of the individual classifiers received via path 106 by averaging in the classifiers for the present frame with the classifiers for previous frames. If speech (non-silence) is present in the frame, silence detector 201 signals statistical calculator 203, generator 206, and averager 202 via path 210.

Statistical calculator 203 calculates statistical distributions for voiced and unvoiced frames. In particular, calculator 203 is responsive to the signal received via path 210 to calculate the overall probability that any frame is unvoiced and the probability that any frame is voiced.

In addition, statistical calculator 203 calculates the statistical value that each classifier would have if the frame was unvoiced and the statistical value that each classifier would have if the frame was voiced. Further, calculator 203 calculates the covariance matrix of the classifiers. Advantageously, that statistical value may be the mean. The calculations performed by calculator 203 are not only based on the present frame but on previous frames as well. Statistical calculator 203 performs these calculations not only on the basis of the classifiers received for the present frame via path 106 and the average of the classifiers received path 211 but also on the basis of the weight for each classifier and a threshold value defining whether a frame is unvoiced or voiced received via path 213 from weights calculator 204.

Weights calculator 204 is responsive to the probabilities, covariance matrix and statistical values of the classifiers for the present frame as generated by calculator 203 and received via path 212 to recalculate the values used as weight vector a, for each of the classifiers and the threshold value b, for the present frame Then, these new values of a and b are transmitted back to statistical calculator 203 via path 213.

Also, weights calculator 204 transmits the weights and the statistical values for the classifiers in both the unvoiced and voiced regions via path 214, determinator 205, and path 208 to generator 206. The latter generator is responsive to this information to calculate the distance measure which is subsequently transmitted via path 109 to comparator 104 as illustrated in FIG. 1.

U/V determinator 205 is responsive to the information transmitted via paths 214 and 215 to determine whether or not the frame is unvoiced or voiced and to transmit this decision via path 110 to multiplexer 105 of FIG. 1.

Consider now in greater detail the operation of each block illustrated in FIG. 2 which is now given in terms of vector and matrix mathematics. Averager 202, statistical calculator 203, and weights calculator 204 implement an improved EM algorithm similar to that suggested in the article by N. E. Day entitled "Estimating the Components of a Mixture of Normal Distributions", Biometrika, Vol. 56, no. 3, pp. 463–474, 1969. Utilizing the concept of a decaying average, classifier averager 202 calculates the average for the classifiers for the present and previous frames by calculating following equations 1, 2, and 3:

$$n=n+1 \text{ if } n<2000 \text{ (1)} \tag{1}$$

$$z=1/ \tag{2}$$

$$X_n=(1-z)\,X_n-1+zx_n \tag{3}$$

$x_n$ is a vector representing the classifiers for the present frame, and n is the number of frames that have been processed up to 2000. z represents the decaying average coefficient, and $X_n$ represents the average of the classifiers over the present and past frames. Statistical calculator 203 is responsive to receipt of the z, $x_n$ and $X_n$ information to calculate the covariance matrix, T, by first calculating the matrix of sums of squares and products, $Q_n$, as follows:

$$Q_n=1-z)Q_{n-1}+zx_nx'_n. \tag{4}$$

After $Q_n$ has been calculated, T is calculated as follows:

$$T=Q_n-X_nX'n. \tag{5}$$

The means are subtracted from the classifiers as follows:

$$x_n = x_n - X_n \tag{6}$$

Next, calculator 203 determines the probability that the frame represented by the present vector $x_n$ is unvoiced by solving equation 7 shown below where, advantageously, the components of vector a are initialized as follows: component corresponding to log of the speech energy equals 0.3918606, component corresponding to log of the LPC gain equals −0.0520902, component corresponding to log area ratio of the first reflection coefficient equals 0.5637082, and component corresponding to squared correlation coefficient equals 1.361249; and b initially equals −8.36454:

$$P(u|x_n) = \frac{1}{1 + \exp(a + x_{n+b})}. \tag{7}$$

After solving equation 7, calculator 203 determines the probability that the classifiers represent a voiced frame by solving the following:

$$P(v \uparrow x_n) = 1 - P(u \uparrow x_n) \tag{8}$$

Next, calculator 203 determines the overall probability that any frame will be unvoiced by solving equation 9 for $p_n$:

$$p_n = (1-z)p_{n-1} + zP(u \uparrow x_n). \tag{9}$$

After determining the probability that a frame will be unvoiced, calculator 203 then determines two vectors, u and v, which give the mean values of each classifier for both unvoiced and voiced type frames. Vectors u and v are the statistical averages for unvoiced and voiced frames, respectively. Vector u, statistical average unvoiced vector, contains the mean values of each classifier if a frame is unvoiced; and vector v, statistical average voiced vector, gives the mean value for each classifier if a frame is voiced. Vector u for the present frame is solved by calculating equation 10, and vector v is determined for the present frame by calculating equation 11 as follows:

$$u_n = (1-z)u_{n-1} + zxnP(u \uparrow x_n)/p_n - zx_n \tag{10}$$

$$v_n = (1-z)v_{n-1} + zxnP(v \uparrow x_n)/(1-pn) - zx_n \tag{11}$$

Calculator 203 now communicates the u and v vectors T matrix, and probability p to weights calculator 204 via path 212.

Weights calculator 204 is responsive to this information to calculate new values for vector a and scalar b. These new values are then transmitted back to statistical calculator 203 via path 213. This allows detector 103 to adapt rapidly to changing environments. Advantageously, if the new values for vector a and scalar b are not transmitted back to statistical calculator 203, detector 103 will continue to adapt to changing environments since vectors u and v are being updated. As will be seen, determinator 205 uses vectors u and v as well as vector a and scalar b to make the voicing decision. If n is greater than advantageously 99, vector a and scalar b are calculated as follows. Vector a is determined by solving the following equation:

$$a = \frac{T^{-1}(v_n - u_n)}{1 - p_n(1 - p_n)(u_n - v_n)'T^{-1}(u_n - v_n)}. \tag{12}$$

Scalar b is determined by solving the following equation:

$$b = -\tfrac{1}{2}a'(u_n + v_n) + \log[(1 - p_n)/p_n]. \tag{13}$$

After calculating equations 12 and 13, weights calculator 204 transmits vectors a, u, and v to block 205 via path 214. If the frame contained silence only equation 6 is calculated.

Determinator 205 is responsive to this transmitted information to decide whether the present frame is voiced or unvoiced. If the element of vector $(v_n - u_n)$ corresponding to power is positive, then, a frame is declared voiced if the following equation is true:

$$a'x_n - a'(u_n + v_n)/2 > 0; \tag{14}$$

or if the element of vector $(v_n - u_n)$ corresponding to power is negative, then, a frame is declared voiced if the following equation is true:

$$a'x_n - a'(u_n + v_n)/2 < 0; \tag{15}$$

Equation 14 can also be rewritten as:

$$a'x_n + b - log[(1-p_n)/p_n] > 0.$$

Equation 15 can also be rewritten as:

$$a'x_n + b - log[(1-p_n)/p_n] < 0.$$

If the previous conditions are not meet, determinator 205 declares the frame unvoiced Equations 14 and 15 represent decision regions for making the voicing decision. The log term of the rewritten forms of equations 14 and 15 can be eliminated with some change of performance. Advantageously, in the present example, the element corresponding to power is the log of the speech energy.

Generator 206 is responsive to the information received via path 214 from calculator 204 to calculate the distance measure, A, as follows. First, the discriminant variable, d, is calculated by equation 16 as follows:

$$d = a'x_n + b - log[(1-p_n)/p_n]. \tag{16}$$

Advantageously, it would be obvious to one skilled in the art to use different types of voicing detectors to generate a value similar to d for use in the following equations. One such detector would be an auto-correlation detector. If the frame is voiced, the equations 17 through 20 are solved as follows:

$$m_1 = (1-z)m_1 + zd, \tag{17}$$

$$s_1 = (1-z)s_1 + zd^2, \text{ and} \tag{18}$$

$$k_1 = s_1 - m_1^2 \tag{19}$$

where $m_1$ is the mean for voiced frames and $k_1$ is the variance for voiced frames.

The probability, $P_d$, that determinator 205 will declare a frame unvoiced is calculated by the following equation:

$$P_d=(1-z)P_d. \tag{20}$$

Advantageously, $P_d$ is initially set to 0.5.

If the frame is unvoiced, equations 21 through 24 are solved as follows:

$$m_0=(1-z)m_0+zd, \tag{21}$$

$$s_0=(1-z)s_0+zd^2,\text{and} \tag{22}$$

$$k_0=s_0-m_0^2. \tag{23}$$

The probability, $P_d$, that determinator 205 will declare a frame unvoiced is calculated by the following equation:

$$P_d=(1-z)P_d+z. \tag{24}$$

After calculating equation 16 through 22 the distance measure or merit value is calculated as follows:

$$A^2 = \frac{P_d\,(1 - P_d)\,(m_1 - m_0)^2}{(1 - P_d)\,k_1 + P_d k_0}. \tag{25}$$

Equation 25 uses Hotelling's two-sample $T^2$ statistic to calculate the distance measure. For equation 25, the larger the merit value the greater the separation. However, other merit values exist where the smaller the merit value the greater the separation. Advantageously, the distance measure can also be the Mahalanobis distance which is given in the following equation:

$$A^2 = \frac{(m_1 - m_0)^2}{(1 - P_d)\,k_1 + P_d k_0}. \tag{26}$$

Advantageously, a third technique is given in the following equation:

$$A^2 = 2\,\frac{(m_1 - m_0)^2}{(k_1 + k_0)}. \tag{27}$$

Advantageously, a fourth technique for calculating the distance measure is illustrated in the following equation:

$$A^2=a'(v_n-u_n) \tag{28}$$

Discriminant detector 102 makes the unvoiced/-voiced decision by transmitting information to multiplexer 105 via path 107 indicating a voiced frame if $a'x+b>0$. If this condition is not true, then detector 102 indicates an unvoiced frame. The values for vector a and scalar b used by detector 102 are advantageously identical to the initial values of a and b for statistical voiced detector 103.

Detector 102 determines the distance measure in a manner similar to generator 206 by performing calculations similar to those given in equations 16 through 28.

Figure 3:
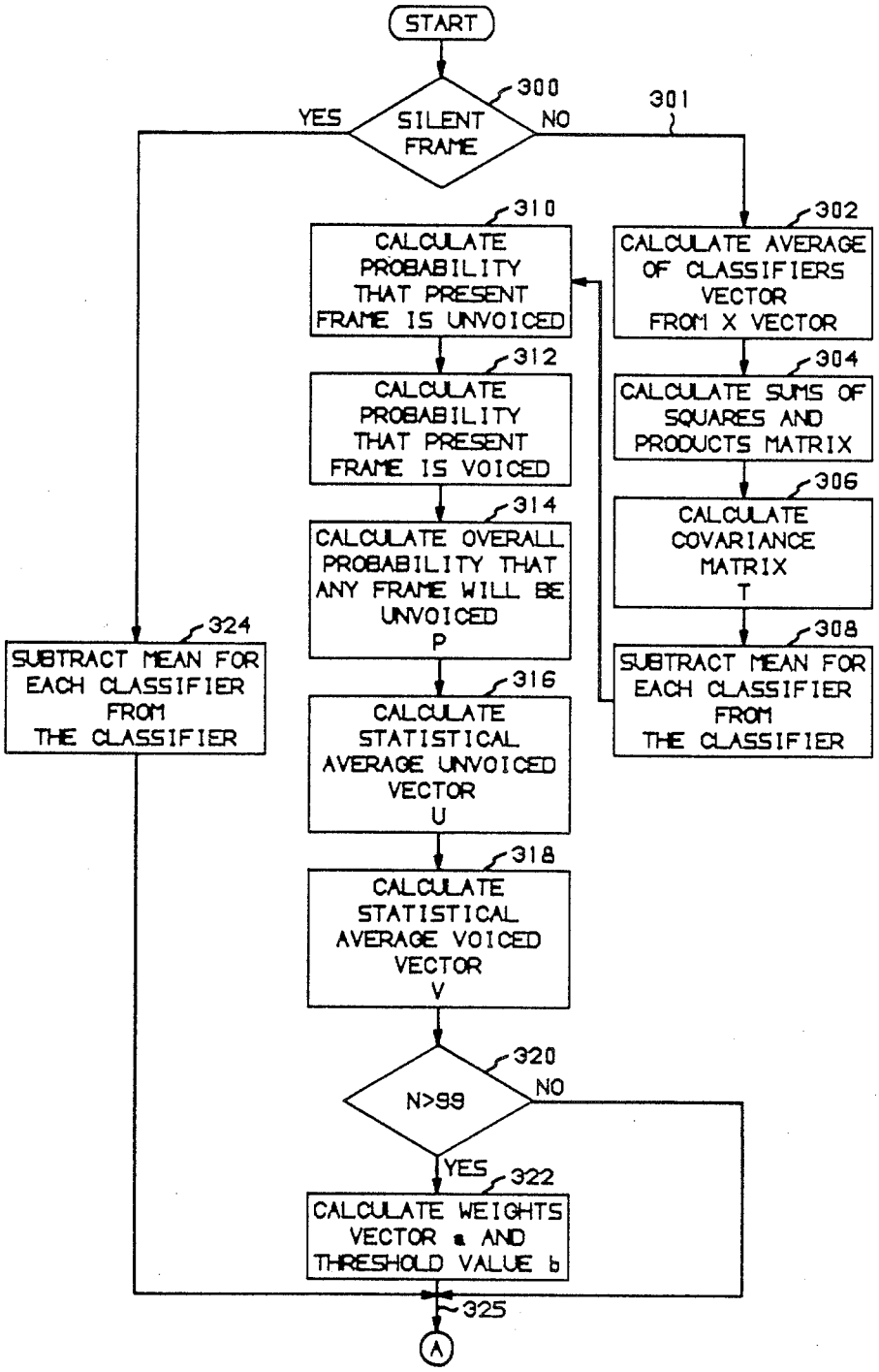
FIGS. 3 and 4 illustrate, in greater detail, the functions performed by statistical voiced detector 103 of FIG. 2.
Figure 4:
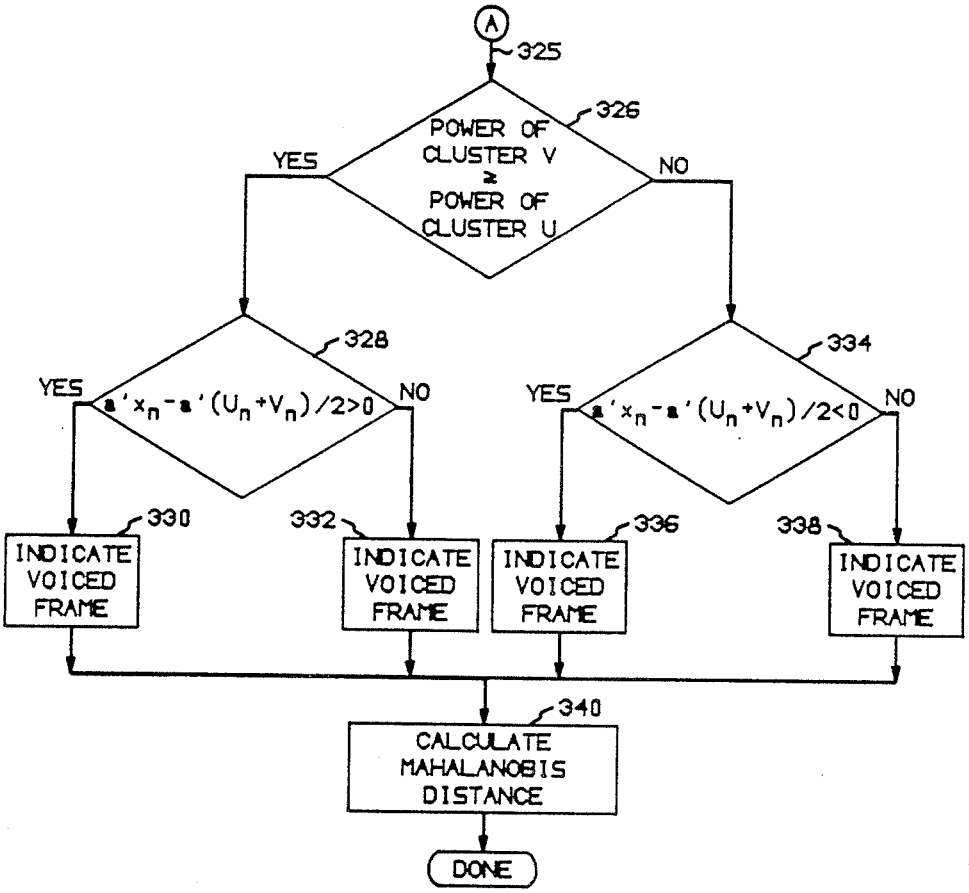

In flow chart form, FIGS. 3 and 4 illustrate, in greater detail, the operations performed by statistical voiced detector 103 of FIG. 2. Blocks 302 and 300 implement blocks 202 and 201 of FIG. 2, respectively. Blocks 304 through 318 implement statistical calculator 203. Blocks 320 and 322 implement weights calculator 204, and blocks 326 through 338 implement block 205 of FIG. 2. Generator 206 of FIG. 2 is implemented by block 340. Subtractor 207 is implemented by block 308 or block 324.

Block 302 calculates the vector which represents the average of the classifiers for the present frame and all previous frames. Block 300 determines whether speech or silence is present in the present frame; and if silence is present in the present frame, the mean for each classifier is subtracted from each classifier by block 324 before control is transferred to decision block 326 However, if speech is present in the present frame, then the statistical and weights calculations are performed by blocks 304 through 322. First, the average vector is found in block 302. Second, the sums of the squares and products matrix is calculated in block 304. The latter matrix along with the vector X representing the mean of the classifiers for the present and past frames is then utilized to calculate the covariance matrix, T, in block 306. The mean X is then subtracted from the classifier vector $x_n$ in block 308.

Block 310 then calculates the probability that the present frame is unvoiced by utilizing the current weight vector a, the current threshold value b, and the classifier vector for the present frame, $x_n$. After calculating the probability that the present frame is unvoiced, the probability that the present frame is voiced is calculated by block 312. Then, the overall probability, $p_n$, that any frame will be unvoiced is calculated by block 314.

Blocks 316 and 318 calculate two vectors: u and v. The values contained in vector u represent the statistical average values that each classifier would have if the frame were unvoiced. Whereas, vector v contains values representing the statistical average values that each classifier would have if the frame were voiced. The actual vectors of classifiers for the present and previous frames are clustered around either vector u or vector v. The vectors representing the classifiers for the previous and present frames are clustered around vector u if these frames are found to be unvoiced; otherwise, the previous classifier vectors are clustered around vector v.

After execution of blocks 316 and 318, control is transferred to decision block 320. If N is greater than 99, control is transferred to block 322; otherwise, control is transferred to block 326. Upon receiving control, block 322 then calculates a new weight vector a and a new threshold value b. The vector a and value b are used in the next sequential frame by the preceding blocks in FIG. 3. Advantageously, if N is required to be greater than infinity, vector a and scalar b will never be changed, and detector 103 will adapt solely in response to vectors v and u as illustrated in blocks 326 through 338.

Blocks 326 through 338 implement u/v determinator 205 of FIG. 2. Block 326 determines whether the power term of vector v of the present frame is greater than or equal to the power term of vector u. If this condition is true, then decision block 328 is executed. The latter decision block determines whether the test for voiced or unvoiced is met. If the frame is found to be voiced in decision block 328, then the frame is so marked as voiced by block 330 otherwise the frame is marked as unvoiced by block 332. If the power term of vector v is less than the power term of vector u for the present frame, blocks 334 through 338 function are executed and function in a similar manner. Finally, block 340 calculates the distance measure.

Figure 5:
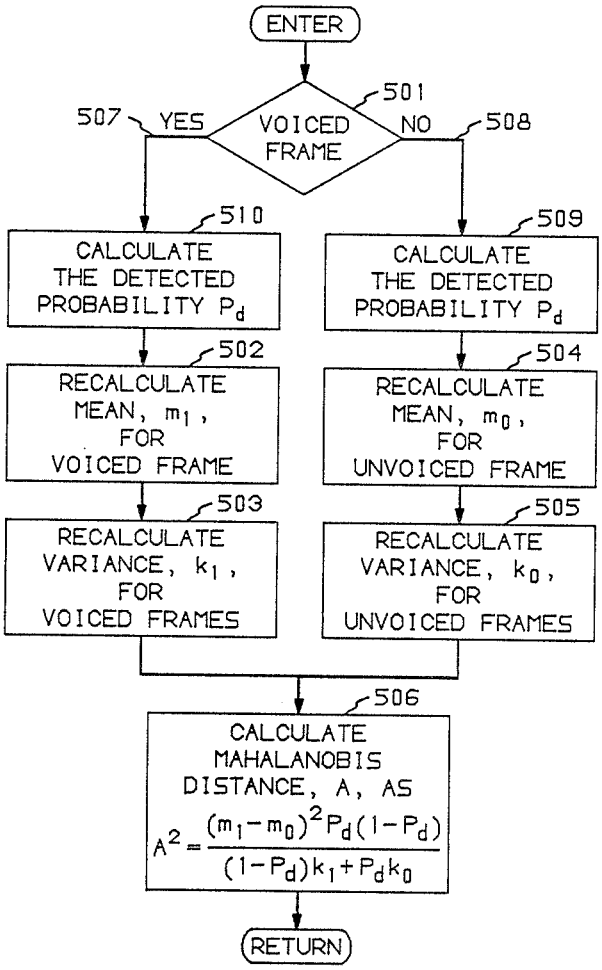
FIG. 5 illustrates, in greater detail, functions performed by block 340 of FIG. 4.

In flow chart form, FIG. 5 illustrates, in greater detail the operations performed by block 340 of FIG. 4. Decision block 501 determines whether the frame has been indicated as unvoiced or voiced by examining the calculations 330, 332, 336, or 338. If the frame has been designated as voiced, path 507 is selected. Block 510 calculates probability $P_d$, and block 502 recalculates the mean, $m_1$, for the voiced frames and block 503 recalculates the variance, $k_1$, for voiced frames. If the frame was determined to be unvoiced, decision block 501 selects path 508. Block 509 recalculates probability $P_d$, and block 504 recalculates mean, $m_0$, for unvoiced frames, and block 505 recalculates the variance $k_0$ for unvoiced frames. Finally, block 506 calculates the distance measure by performing the calculations indicated.

A routine for implementing generator 100 of FIG. 1 is illustrated in Appendix A, and another routine that implements blocks 102 through 105 of FIG. 1 is illustrated in Appendix B. The routines of Appendices A and B are intended for execution on a Digital Equipment Corporation's VAX 11/780-5 computer system or a similar system.

It is to be understood that the afore-described embodiment is merely illustrative of the principles of the invention and that other arrangements may be devised by those skilled in the art without departing from the spirit and the scope of the invention. In particular, the calculations performed per frame or set could be performed for a group of frames or sets.

APPENDIX A

```
/*clasifier generator.  print classifiers to stdout.*/
#include <stdio.h>
#include <math.h>

main(argc,argv)
short argc;
char *argv[];
{
short i,j,m,L,N;
long counter;
short fid1,nn[1]; /*File identifiers and 1 byte storage*/
float corr(),storecorr;
int maxi[7];
float bdR[200],eR[200],extraR[15];
int isi[1000];          /*(isignal) Four frames of speech on [0,4L-1]*/
float stepR,stepdR;
float S1,S2,R,RR;
float Power[7],POWER[7]; /*spch Power, res POWER*/
float coeff[10][15];
if(argc < 3)
{   printf("usage: classgen speechfile L > 4pars\n");
    exit(1);
}
if((fid1=open(argv[1],0))== -1)
{
    printf("Cannot open %s\n",argv[1]);
    exit(1);
}
counter=1;      /*frame counter*/
L=atoi(argv[2]);            /*frame length in 8KHz samples*/
N=10;           /*LPC filter order*/
m=0;    /*inframe counter*/
while( read(fid1,nn,2) == 2 )
{   m=m+1;
    if(m==1) Power[1]=0.0;
    Power[1]=Power[1] + (float)nn[0]*(float)nn[0];
    RR=eR[m+N-1]=bdR[m+N]=nn[0];
    isi[3*L+m-1]=nn[0];/*Put in frame 4, use when data reaches frame 2*/
    if( m >= L-(N-1) ) extraR[m-(L-N)]=RR;
    if( m%L == 0)
    {   for(j=1;j<=N;++j)
        {   S1=0.0;
            S2=0.0;
            for(i=N;i<=L+N-1;++i)
            {   S1=S1+eR[i]*eR[i]+bdR[i]*bdR[i];
                S2=S2+eR[i]*bdR[i];
            }
            if(S1 == 0.0) coeff[1][j] = 0.0;
            else coeff[1][j] = -2.0*S2/S1;

            for(i=1;i<=L+N-1;++i)
            {   R=eR[i]+bdR[i]*coeff[1][j];
                stepR=bdR[i]+eR[i]*coeff[1][j];
                eR[i]=R;
                bdR[i]=stepdR;
                stepdR=stepR;
            }
        } /*j=1,N*/
```

```
            POWER[1]=0.0;
            for(i=1;i<=L;++i) POWER[1]=POWER[1]+eR[i+N-1]*eR[i+N-1];

            bdR[1]=extraR[1];
            for(i=1;i<=N-1;++i) eR[i]=bdR[i+1]=extraR[i+1];

            if(counter>2)
            {   maxi[2]=maxi[1];
                storecorr=corr(&maxi[1],isi,L);          /*loads maxi[1]*/
                maxi[0]=abs(maxi[2]-maxi[1]);
                printf("%f ",log(Power[3]));            /*log speech Power*/
                printf("%f ",log(Power[3]/POWER[3])); /*Pp - log LPC gain*/
                printf("%f ",log((1-coeff[3][1])/(1+coeff[3][1]))); /*LAR1*/
                printf("%f ",storecorr );               /*cordata or rhomax*/
                printf("\n");
            } /*counter>2*/
            m=0;
            counter=counter+1;
            for(i=0;i<3*L;i++) isi[i]=isi[i+L];
            for(j=4;j>1;j=j-1) for(i=1;i<=N;++i) coeff[j][i]=coeff[j-1][i];
            for(j=5;j>1;j=j-1){
                POWER[j]=POWER[j-1];
                Power[j]=Power[j-1];
            }
        }
    }
    }/*main*/


    float corr(maxi,isi,L)  /*Find max corr_coef^2 of frame [L,2*L-1]*/
    int *maxi;
    int isi[];
    short L;
    {   float cora,corb,corc,corcof,max= -1;
        short i,j,Li2;
        for(i=20;i<L;i++) /*Try all pitches > 20 and < L*/
        {   Li2 = L - i/2;
            cora=corb=corc=0.0;
            for(j=0;j<L;j++)
            {   cora += isi[Li2+j]   * isi[Li2+j];
                corb += isi[Li2+i+j] * isi[Li2+i+j];
                corc += isi[Li2+j]   * isi[Li2+i+j];
            }
            if(corc==0.0) cora=corb=1.0; /*divide by 0 protection*/
            corcof = corc*corc/(cora*corb);
            if(corcof>max)
            {   max = corcof;
                *maxi = i;
            }
        }
        return(max);
    }
```

APPENDIX B

- 21 -

```
/*Performs clustering on D floating ASCII parameters*/
#include <stdio.h>
#include <math.h>
#define K 4      /*Number of different weight vectors to select from*/
#define D 4      /*Number of classifiers*/

main(argc,argv)
int argc;
char *argv[];
{   float cluster(),fixed(),thresh(),lopass();
    int mahal();
    float z[D][1],M[K],d[K];
    int max,speech;
    static long frameno=0;

    if(argc>1)
        {printf("usage:  %s < par.list (54.s.4pars)\n",argv[0]); exit(1);}
    while(1==1)
    {   frameno++;
        if(scanf("%f%f%f%f",
            &z[0][0],&z[1][0],&z[2][0],&z[3][0])==EOF)exit();
        d[0]=fixed(z);
        d[1]=lopass(z);
        d[2]=thresh(z);
        d[3]=cluster(&speech,z);
        if(speech==1) max=mahal(M,d);
        if(d[max]>0) printf("1 ");  /*Declare frame voiced*/
        else printf("0 ");          /*Declare frame unvoiced*/
        printf("\n");
    }
}
int mahal(M,d)  /*return index of largest mahalanobis distance.*/
float M[],d[];
{   static float u0[K],s0[K],v0[K],u1[K],s1[K],v1[K],p[K];
    float alpha;
    static int N=0;
    int i,max;
    if(N<200) N++;
    alpha=1.0/(float)N;
    for(i=0;i<K;i++)
    {   if(fabs(d[i])<50.0) /*limit transient divergence*/
        {   if(d[i]<0) /*if unvoiced*/
            {   p[i] = (1-alpha)*p[i] + alpha;/*p is prob of unvoiced*/
                u0[i] = (1-alpha)*u0[i] + alpha*d[i];
                s0[i] = (1-alpha)*s0[i] + alpha*d[i]*d[i];
                v0[i] = s0[i] - u0[i]*u0[i];
            }
            else /*if voiced*/
            {   p[i] = (1-alpha)*p[i];
                u1[i] = (1-alpha)*u1[i] + alpha*d[i];
                s1[i] = (1-alpha)*s1[i] + alpha*d[i]*d[i];
                v1[i] = s1[i] - u1[i]*u1[i];
            }
        }
        if(p[i]*v0[i]+(1-p[i])*v1[i] > 0.0)
            M[i] = (u0[i]-u1[i])*(u0[i]-u1[i])/(p[i]*v0[i] +
                    (1-p[i])*v1[i]);
    }
    for(max=0,i=1;i<K;i++) if(M[i]>M[max]) max=i;
    return(max);
}
float thresh(y) /*statistical and threshold calculator*/
float y[D][1]; /*y[0][0] is log(Power)*/
{   void invert(), matmult(), transpose(), sum();
    static float a,u1,u2;
    static float z,zbar;
    static float Q,T;
    static float b,p,p1z,p2z;
    static float powermin,freezeframe=0;
    static long frameno=0,N=0;
    float alpha,dscr;
    float fixed();

    frameno++;                                  /*frame counter*/
    z=fixed(y);          /*Find discriminant variable from weighted sum*/
    if(N==0)
    {   a = 1.0;
        b = 0.0;
        p = 0.5;
    }
```

```
87          if(freezeframe<20 && y[0][0]>9) freezeframe++;
88          if(freezeframe==2 && y[0][0]>9) powermin=y[0][0]; /*init*/
89          else if(freezeframe>0)
90          {   if(powermin<y[0][0]) powermin += 0.02/freezeframe;
91              else    powermin -= 0.98/freezeframe;
92          }
93
94
95
96
97
98
99
100
101
102
103
104
105
106
107         if(y[0][0]-log(10.0)>powermin)                    /*Silence detector*/
108         {   if(N<100) N++;
109             alpha = 1.0/(float)N;
110             zbar = (1-alpha)*zbar + alpha*z;
111             Q = (1-alpha)*Q + alpha*z*z;
112             T = Q - zbar*zbar;
113             z = z - zbar;
114             if(a*z+b>70) p1z=0;
115                 else p1z = 1/(1 + exp(a*z+b));
116             if(N==1) p1z=0.5;
117             p2z = 1 - p1z;
118             p = (1-alpha)*p + alpha*p1z;
119             u1 = (1-alpha)*u1 + alpha*z*p1z/p - alpha*z;
120             u2 = (1-alpha)*u2 + alpha*z*p2z/(1-p) - alpha*z;
121             if( N>99 )
122             {   a = (u2-u1)/( T-p*(1-p)*(u2-u1)*(u2-u1) );
123             }
124             b = -0.5*a*(u2+u1) + log((1-p)/p);
125         }   /*Silence detector*/
126         else
127             z = z - zbar;
128         dscr = z - 0.5*(u2+u1);
129         if(a<0) dscr= -dscr;                /*loudest cluster is voiced*/
130         fflush(stdout);
131         return(dscr);       /*Voiced iff dscr > 0.0*/
132     }
133     float fixed(z) /*discriminant analysis for normal speech*/
134     float z[D][1];
135     {   return(z[0][0]  *  0.3918606 +
136                z[1][0] * -0.0520902 +
137                z[2][0] *  0.5637082 +
138                z[3][0] *  1.361249  +
139                - 8.36454);
140     }
141     float lopass(z) /*discriminant analysis for low pass filtered speech*/
142     float z[D][1]; /*z[0][0] is log(Power)*/
143     {   return(z[0][0]  *  0.3199999 +
144                z[1][0] *  0.2897963 +
145                z[2][0] * -0.1820704 +
146                z[3][0] *  1.636398 +
147                - 7.23397);
148     }
149     float cluster(speech,safez) /*Statistical voiced detector*/
150     int *speech;    /*returns silence decision:  0=silence, 1=speech*/
151     float safez[D][1]; /*safez[0][0] is log(Power)*/
152     {   void invert(), matmult(), transpose(), sum();
153         static float a[D][1],u1[D][1],u2[D][1];
154         static float zbar[D][1];
155         static float Q[D][D],T[D][D],Tinv[D][D];
156         static float b,p,p1z,p2z;
157         static float powermin,freezeframe=0;
158         static long frameno=0,N=0;
159         float z[D][1];
160         float u1mu2[D][1],u2mu1[D][1],u1pu2[D][1],vector[D][1];
161         float trans[1][D],matrix[D][D];
162         float alpha,beta,scalar,dscr;
163
164         sum(z,safez,safez,0.0,1.0,D,1); /*copy safez to z*/
165         frameno++;/*frame counter*/
166         if(N==0)
167         {   a[0][0]= -0.3918606; /*Start at discriminant values*/
168             a[1][0]=  0.0520902;
169             a[2][0]= -0.5637082;
170             a[3][0]= -1.361249;
171             b = 8.36454;
172             p = 0.5;
173         }
174         if(freezeframe<20 && z[0][0]>9) freezeframe++;
175         if(freezeframe==2 && z[0][0]>9) powermin=z[0][0]; /*init*/
176         else if(freezeframe>0)
177         {   if(powermin<z[0][0]) powermin += 0.02/freezeframe;
178             else    powermin -= 0.98/freezeframe;
```

```
179         }
180         if(z[0][0]-log(10.0)>powermin)                    /*Silence detector*/
181         {   *speech=1;
182             if(N<2000) N++;
183             alpha = 1.0/(float)N;
184             beta = 1.0 - alpha;
185             sum(zbar,zbar,z,beta,alpha,D,1);        /*  Find zbar          */
186             transpose(trans,z,D,1);                 /*  Find T:  START     */
187             matmult(matrix,z,trans,D,1,D);          /*  matrix = z%*t(z)   */
188             sum(Q,Q,matrix,beta,alpha,D,D);         /*                     */
189             transpose(trans,zbar,D,1);              /*                     */
190             matmult(matrix,zbar,trans,D,1,D);       /*  matrix = v%*t(v)   */
191             sum(T,Q,matrix,1.,-1.,D,D);             /*  T = Q - v%*t(v)    */
192             sum(z,z,zbar,1.,-1.,D,1);               /*  z+ = z - z_        */
193             transpose(trans,a,D,1);
194             matmult(vector,trans,z,1,D,1);          /* vector = t(a) %* z */
195
196
197
198
199
200
201
202
203
204
205
206
207             scalar = vector[0][0] + b;              /* scalar = t(a)%*z+b */
208             if(scalar>70)   p1z=0;
209                 else        p1z=1/(1 + exp(scalar));
210             if(N==1) p1z=0.5;
211             p2z = 1.0 - p1z;
212             p = beta*p + alpha*p1z;
213             sum(u1,u1,z,beta,alpha*p1z/p - alpha,D,1);
214             sum(u2,u2,z,beta,alpha*p2z/(1.0 - p) - alpha,D,1);
215             if( N>99 )
216             {   invert(Tinv,T,D);
217                 sum(u1mu2,u1,u2,1.,-1.,D,1);        /*u1mu2 = u1 - u2  */
218                 sum(u2mu1,u2,u1,1.,-1.,D,1);        /*u2mu1 = u2 - u1  */
219                 matmult(vector,Tinv,u1mu2,D,D,1);   /*v = Tinv %* u1mu2*/
220                 transpose(trans,u1mu2,D,1);
221                 matmult(vector,trans,vector,1,D,1); /*v=t(u1mu2)T%*u1mu2*/
222                 scalar = 1.0/(1 - p*(1-p)*vector[0][0]);
223                 matmult(vector,Tinv,u2mu1,D,D,1);       /*v=-Tinv(u2-u1)*/
224                 sum(a,vector,vector,0.,scalar,D,1); /*a <- .../(...)*/
225             }   /*N>*/
226             sum(u1pu2,u1,u2,1.,1.,D,1);         /******FIND B***********/
227             transpose(trans,a,D,1);
228             matmult(vector,trans,u1pu2,1,D,1);  /*vector = t(a)%*(u1+u2)*/
229             b = -0.5*vector[0][0] + log((1-p)/p);
230         }   /*Silence detector*/
231         else
232         {   *speech=0;
233             sum(z,z,zbar,1.,-1.,D,1);               /*  z+ = z - z_    */
234         }
235         transpose(trans,a,D,1);
236         matmult(vector,trans,z,1,D,1);
237         dscr = vector[0][0] + b - log((1-p)/p); /*Maximum likelihood est.*/
238         if(u2[0][0]-u1[0][0]<0) dscr= -dscr;    /*louder cluster is voiced*/
239         fflush(stdout);
240         return(dscr);       /*Voiced iff dscr > 0.0*/
241     }
242     /*A (n X n) is indexed from 0 to n-1*/
243     void invert(B,A,n)      /* B <- inverse(A)                  */
244     float A[],B[];          /* A and B may be same array        */
245     long n;
246     {
247         long i;
248         long j;
249         long k;
250         long m;
251         long q;
252         float s;
253         float t;
254         float x[25];    /* needs order of matrix as dimension   */
255         float a[25*25]; /* needs (order^2+1)/2 of matrix as dimension   */
256
257         for(i=1;i<=n;i++)   /*Copy A[][] to a[]*/
258             for(j=1;j<=i;j++)
259                 a[i*(i-1)/2 + j] = A[n*(i-1)+(j-1)]; /*A[i][j]==A[n*i+j]*/
260         for( k=n; k>=1; k--){
261             s = a[1];
262             if( s <= 0.0){
263                 printf("singular matrix=%f\n",s);
264                 exit(1);
265             }
266             else{
267                 m = 1;
268                 for( i=2; i<=n ; i++){
269                     q = m;
270                     m = m + i;
271                     t = a[q + 1];
```

```
                x[i] = -t / s;
                if( i>k ) {
                    x[i] = -x[i];
                }
                for( j=(q+2); j<=m; j++){
                    a[j - i] = a[j] + t * x[j - q];
                }
            }
            q = q - 1;
            a[m] = 1.0 / s;
            for( i=2; i<=n; i++){
                a[q + i] = x[i];
            }
        }
    }/*k*/

    for(i=1;i<=n;i++)   /*Copy a[] to B[][]*/
        for(j=1;j<=i;j++)
            B[n*(i-1)+(j-1)] = a[i*(i-1)/2 + j]; /*B[i][j]==B[n*i+j]*/

    for(i=0;i<n;i++)    /*Copy bottom half of B[][] to top*/
        for(j=0;j<i;j++)
            B[j*n+i]=B[i*n+j];  /*B[j,i]=B[i,j]*/
}
```

```
void transpose( at, a, dim1, dim2)

float a[];  /* dim1 X dim2 matrix       */
float at[]; /* transposed output of a   */
long dim1;
long dim2;
{
    long i;
    long j;
    long offset2;
    long offset1;

    offset2 = 0;
    for(i=0; i<dim1; i++){
        offset1 = 0;
        for(j=0; j<dim2; j++){
            at[i+offset1] = a[j+offset2];
            offset1 += dim1;
        }
        offset2 += dim2;

    }
}
/*****************************************************************/
/*      matmult( A, B, C, dimm, dimn, dimr)                      */
/*                                                               */
/*      C(dimmxdimr) = A(dimmxdimn) x B(dimnxdimr)               */
/* note : notation is A[i,j] = A[dimn*i+j]                       */
/*      UNIX V:  a[i][j]==a[0][n*i+j] (a is m X n).              */
/*      C[i,j]=sum(from 0 to dimn-1) A[i,k]*B[k,j]               */
/*****************************************************************/
/*NOTE A & C, and B & C must be different unless C is 1 X 1*/

void matmult( C, A, B, dimm, dimn, dimr)
float A[],B[],C[];
long dimm,dimn,dimr;
{   long i,j,k;
    float sum;
    for(i=0;i<dimm;i++)
        for(j=0;j<dimr;j++) /*sweep C[i,j]*/
        {   sum=0.0;
            for(k=0;k<dimn;k++)
                sum += A[dimn*i+k]*B[dimr*k+j];
            C[dimr*i+j]=sum;
        }
}   /*Worked first time!*/
/*UNIX V:  a[i][j]==a[0][n*i+j] (a is m X n).*/
void sum(c,a,b,w1,w2,m,n)       /*  weighted sum of two matrices    */
float a[],b[],c[],w1,w2;        /*  c = w1*a + w2*b                 */
long m,n;                       /*  a, b, and c are m X n           */
{   long i,j;
    for(i=0;i<m;i++)
        for(j=0;j<n;j++) c[n*i+j] = w1*a[n*i+j] + w2*b[n*i+j];
}
```

What is claimed is:

1. An apparatus for determining voicing in frames of non-training set speech and each of said frames being unvoiced, voiced or silent and said apparatus having a plurality of detecting means for performing a voicing decision and for indicating the voicing decision in a frame, comprising:

each of the detecting means comprises means for calculating a merit value defining the separation between voiced and unvoiced decision regions for present and previous ones of said frames of non-training set speech; and means for selecting one of said detecting means to indicate the voicing decision for said present one of said frames of non-training set speech upon the selected one of said detecting means calculating a merit value better than any other one of said detecting means' calculated merit value.

2. The apparatus of claim 1 wherein said calculating means of each of said detecting means performs a statistical calculation to determine said merit value.

3. The apparatus of claim 2 wherein said statistical calculations are distance measurement calculations.

4. The apparatus of claim 2 wherein one of said detecting means for indicating a frame is voiced upon detecting said fundamental frequency and indicating a frame is unvoiced upon said fundamental frequency being absent;

said calculating means for said one of said detecting means further comprises means for determining a discriminant variable for each ones of previous and present frames;

means for determining a mean value for voiced ones of said previous and present frames;

means for determining a variance value of said voiced ones of said previous and present frames;

means for determining a mean value of said unvoiced ones of said previous and present frames;

means for determining a variance value of said unvoiced ones of said previous and present frames; and means for determining the merit value of said one of said detecting means from the determined voiced mean and variance values and the determined unvoiced mean and variance values.

5. The apparatus of claim 4 wherein said means for determining the merit value for said one of said detecting means comprises means for summing said variance values;

means for calculating a weighted sum of said variance values;

means for subtracting the mean value of said unvoiced frames from said mean value of said voiced frames;

means for squaring the subtracted value; and means for dividing said weighted sum by the sum of said squared values, thereby generating said merit value for said one of said detecting means.

6. The apparatus of claim 5 wherein said means for calculating said weighted sum comprises means for calculating a first probability that said one of said detecting means indicates the presence of voicing in said present frame.

means for calculating a second probability that said one of said detecting means indicates non-voicing in said present frame;

means for multiplying said variance of said voiced ones of said previous and present frames by said first probability and said variance of said unvoiced ones of said previous and present frames by said second probability; and means for forming said weighted sum from the results of said multiplications.

7. The apparatus of claim 6 wherein said means for dividing comprises means for multiplying the results of the division of said weighted sum by the sum of said squared values by said first and second probabilities to generate said merit value of said one of said detecting means.

8. The apparatus of claim 7 wherein said one of said detecting means further comprises a means responsive to a set of classifiers defining speech attributes of said present frame of non-training set speech for calculating a set of statistical parameters;

means responsive to the calculated set of parameters for calculating a set of weights each associated with one of said classifiers; and means responsive to the calculated set of weights and classifiers and said set of parameters for performing the voicing decision for said present frame of non-training set speech.

9. The apparatus of claim 8 wherein said means for calculating said set of weights comprises means for calculating a threshold value in response to said set of said parameters;

means for communicating said set of weights and said threshold value to said means for calculating said set of statistical parameters to be used for calculating another set of parameters for another one of said frames of speech; and said means for calculating said set of statistical parameters further responsive to the communicated set of weights and another set of classifiers defining said speech attributes of said other frame for calculating another set of statistical parameters.

10. An apparatus for determining voicing in frames of non-training set speech and each of said frames being unvoiced, voiced or silent, comprising:

first means for generating a first signal indicating voicing in a present one of said frames of non-training set speech;

second means for generating a second signal indicating voicing in said present one of said frames of non-training set speech;

said first means comprises means for calculating a first generalized distance value representing the degree of separation between voiced and unvoiced decision regions as determined by said first means for present and previous ones of said frames;

said second means comprises means for calculating a second generalized distance value representing the degree of separation between voiced and unvoiced decision regions as determined by said second means for present and previous ones of said frames; and means for selecting said first signal to indicate the voicing decision upon said first generalized value being better than said second generalized value and for selecting said second signal to indicate the voicing decision upon said second generalized value being better than said first generalized value.

11. The apparatus of claim 10 wherein said generalized distance values are the Mahalanobis distance values.

12. The apparatus of claim 11 wherein said first means further comprises a means responsive to a set of classifiers defining speech attributes of one frame of speech for calculating a set of statistical parameters;

means responsive to the calculated set of parameters for calculating a set of weights each associated with one of said classifiers; and means responsive to the calculated set of weights and classifiers and said set of parameters for determining the voicing in said present ones of said frames of non-training set speech.

13. The apparatus of claim 12 wherein said means for calculating said first generalized distant value comprises means responsive to said calculated set of parameters and said calculated set of weights for determining said first generalized distance value.

14. The apparatus of claim 13 wherein said second means is a discriminant voiced detector.

15. The apparatus of claim 14 wherein said means for calculating said second generalized distance value comprises means for determining a mean value for voiced ones of said previous and present frames;

means for determining a mean value of said unvoiced ones of said previous and present frames;

means for determining a variance value of said unvoiced ones of said previous and present frames; and means for determining said second distance measurement value from the determined voiced mean and variance values and the determined unvoiced means and variance values.

16. The apparatus of claim 15 wherein said means for determining said second distance measurement value comprises means for calculating the weighted sum of said variance values;

means for subtracting the mean value of said unvoiced frames from said mean value of said voiced frames;

means for squaring the subtracted value; and means for dividing said weighted sum of said variance values by the sum of said squared values thereby generating said second distance measurement value.

17. A method for determining voicing in frames of non-training set speech having a first and second voiced detectors for performing a voicing decision and for indicating the voicing decision in a frame, comprising the steps of:

calculating a first merit value defining the separation between voiced and unvoiced decision regions for present and previous ones of said frames of non-training set speech by said first voiced detector;

calculating a second merit value defining separation between voiced and unvoiced decision regions for present and previous frames of non-training set speech by said second voiced detector; and selecting said first voiced detector to indicate the voicing decision upon said first merit value being better than said second value and selecting said second voiced detector to indicate the voicing decision upon said second merit value being better than said first value.

18. The method of claim 17 wherein said steps of calculating said first and second values each comprises the step of performing a statistical calculation to determine said first and second values, respectfully.

19. The method of claim 18 wherein said statistical calculations are distance measurement calculations.

20. The method of claim 18 wherein said step of calculating said first value further comprises the steps of determining a discriminant variable for each ones of previous and present frames;

determining a mean value for voiced ones of said previous and present frames;

determining in response to said mean value for voiced ones of said previous and present frames a variance value of said voiced ones of said previous and present frames;

determining a mean value of said unvoiced ones of said previous and present frames;

determining in response to said mean value for unvoiced ones of said previous and present frames a variance value of said unvoiced ones of said previous and present frames; and determining said first value from the determined voiced mean and variance values and the determined unvoiced mean and variance values.

21. The method of claim 20 wherein said step of determining said first value comprises the steps of summing said variance values;

calculating the weighted sum of said variance values;

subtracting the mean value of said unvoiced frames from said mean value of said voiced frames;

squaring the subtracted values; and dividing said weighted sum of variance values by the sum of said squared variance values thereby generating said statistical value.

22. The method of claim 21 wherein said step of calculating said weighted sum comprises the steps of calculating a first probability that said step of determining said first value indicates the presence of voicing in said present frame;

calculating a second probability that said step of determining said first value indicates the non-voicing in said present frame;

multiplying said variance of said voiced ones of said previous and present frames by said first probability and said variance of said unvoiced ones of said previous and present frames by said second probability; and forming said weighted sum from the results of said multiplications.

23. The apparatus of claim 22 wherein said step of dividing comprises the step of multiplying the results of the division of said weighted sum by the sum of said squared values by said first and second probabilities to generate said first value.

* * * * *